US010334891B2

(12) United States Patent
Weber-Unger

(10) Patent No.: US 10,334,891 B2
(45) Date of Patent: Jul. 2, 2019

(54) BRASSIERE WITH A CONCEALING ELEMENT

(71) Applicant: Edelweiss basics GmbH & Co. KG, Brannenburg (DE)

(72) Inventor: Georg Weber-Unger, Kufstein (AT)

(73) Assignee: EDELWEISS BASICS GMBH & CO. KG, Brannenburg (DE)

( * ) Notice: Subject to any disclaimer, the term of this patent is extended or adjusted under 35 U.S.C. 154(b) by 270 days.

(21) Appl. No.: 14/993,913

(22) Filed: Jan. 12, 2016

(65) Prior Publication Data

US 2016/0338423 A1 Nov. 24, 2016

(30) Foreign Application Priority Data

May 18, 2015 (DE) ..... 20 2015 003 607 U
Aug. 18, 2015 (EP) ..... 15002455

(51) Int. Cl.

| | |
|---|---|
| ***A41C 3/12*** | (2006.01) |
| ***A41C 3/00*** | (2006.01) |
| ***A41C 3/14*** | (2006.01) |
| ***A41C 3/10*** | (2006.01) |
| *A41C 3/08* | (2006.01) |

(52) U.S. Cl.

CPC ..... *A41C 3/12* (2013.01); *A41C 3/0007* (2013.01); *A41C 3/0085* (2013.01); *A41C 3/10* (2013.01); *A41C 3/14* (2013.01); *A41C 3/144* (2013.01); *A41C 3/0057* (2013.01); *A41C 3/08* (2013.01)

(58) Field of Classification Search

CPC .. A41C 3/00; A41C 3/144; A41C 3/10; A41C 3/0014; A41C 3/0057; A41C 3/0035; A41C 3/0042; A41C 3/14

USPC ..... 450/37, 36, 38, 39, 54–57, 41, 40, 64

See application file for complete search history.

(56) References Cited

U.S. PATENT DOCUMENTS

| | | | | |
|---|---|---|---|---|
| 2,594,549 A * | 4/1952 | Flores | A41C 3/00 | 2/267 |
| 2,664,568 A * | 1/1954 | Wegman | A41C 3/00 | 450/1 |
| 3,101,717 A * | 8/1963 | Korman | A41C 3/10 | 156/167 |
| 4,419,997 A * | 12/1983 | Cole | A41C 5/005 | 450/40 |
| 4,557,267 A * | 12/1985 | Cole | A41C 3/00 | 450/40 |
| 5,492,501 A * | 2/1996 | Brown | A41C 3/12 | 2/73 |
| 6,174,217 B1 * | 1/2001 | Judson | A41C 3/0042 | 2/406 |
| 6,645,040 B2 * | 11/2003 | Rabinowicz | A41C 3/0014 | 450/1 |

(Continued)

FOREIGN PATENT DOCUMENTS

| | | |
|---|---|---|
| CN | 201418387 Y | 3/2010 |
| CN | 102123619 A | 7/2011 |

(Continued)

*Primary Examiner* — Gloria M Hale

(74) *Attorney, Agent, or Firm* — Roberts Mlotkowski Safran Cole & Calderon P.C.

(57) ABSTRACT

A brassiere having cups, straps and elements for covering the wearer's breast tip region, wherein the elements are respectively arranged on the cups' inner side facing the wearer's body, and the elements only partly cover the cups' inner side facing the wearer's body.

30 Claims, 7 Drawing Sheets

(56) References Cited

Figure 1:
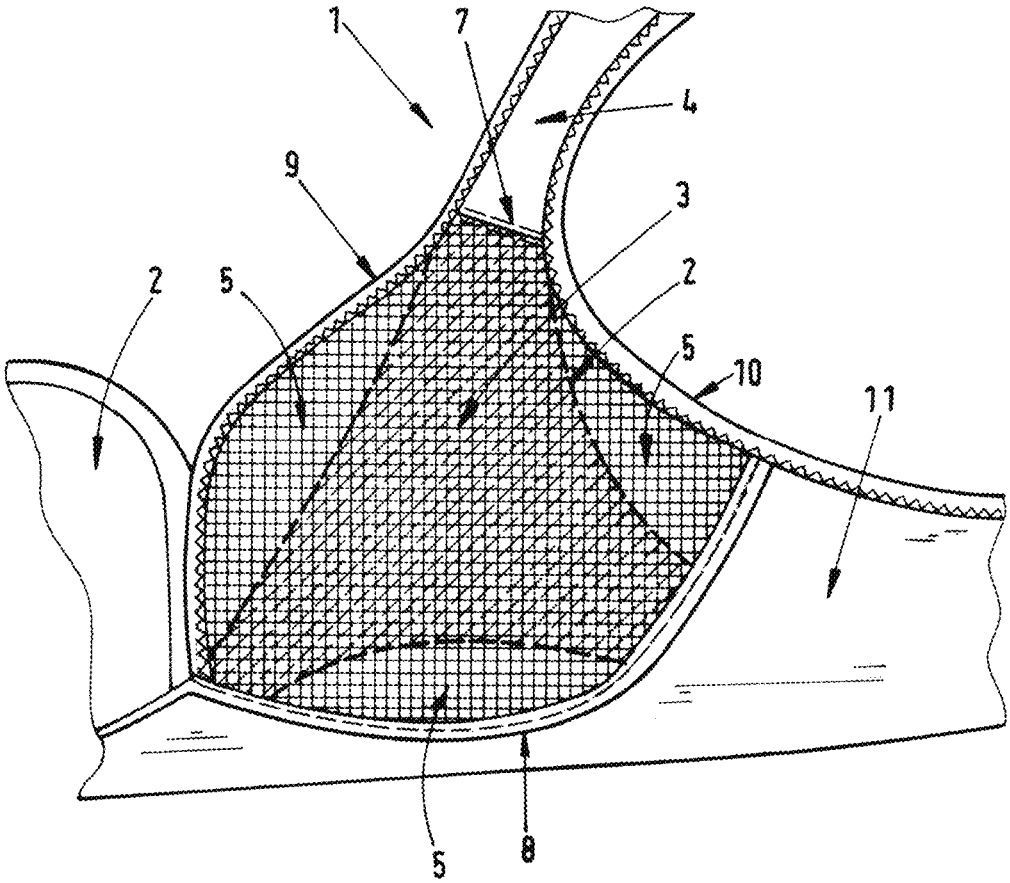

U.S. PATENT DOCUMENTS 6,881,123 B1 * 4/2005 Klakauskas ..... A41C 3/10 450/39
7,081,035 B2 * 7/2006 Kawakami ..... A41C 3/005 450/59
7,727,048 B2 * 6/2010 Gransberry ..... A41C 3/144 450/37
7,815,488 B2 * 10/2010 Gransberry ..... A41C 3/10 450/37
7,988,526 B2 * 8/2011 Gransberry ..... A41C 3/144 450/37
8,419,502 B2 * 4/2013 Liu ..... A41C 3/144 450/39
8,545,287 B2 * 10/2013 Campbell ..... A41C 3/0021 450/30
8,657,643 B2 * 2/2014 Perez ..... A41C 3/0035 450/36
9,456,638 B2 * 10/2016 Abbott ..... A41C 3/14
2006/0025043 A1 2/2006 Kawakami
2007/0155283 A1 * 7/2007 McQueer ..... A41C 3/0057 450/39
2008/0026676 A1 * 1/2008 Rothman ..... A41C 3/08 450/36
2008/0125012 A1 * 5/2008 Gransberry ..... A41C 3/144 450/64
2008/0146118 A1 * 6/2008 Solberg ..... A61M 1/066 450/1
2008/0176485 A1 7/2008 Linkon
2009/0130953 A1 * 5/2009 Gransberry ..... A41C 3/10 450/39
2011/0092134 A1 * 4/2011 Alva ..... A41C 3/04 450/36
2011/0201252 A1 * 8/2011 Campbell ..... A41C 3/0021 450/39
2012/0129427 A1 5/2012 Perez
2012/0149278 A1 * 6/2012 Liu ..... A41C 3/144 450/57
2012/0276811 A1 11/2012 Nakajima et al.
2015/0024658 A1 * 1/2015 Abbott ..... A41C 3/14 450/39

FOREIGN PATENT DOCUMENTS

CN 204157663 U 2/2015
DE 19723317 A1 12/1998
DE 202013003542 U1 7/2014
WO 2012/078387 A1 6/2012

* cited by examiner

BRASSIERE WITH A CONCEALING ELEMENT

This invention relates to a brassiere, in particular a brassiere having an element.

Brassieres have the basic and essential function of supporting and holding the wearer's breasts. Besides having this support function, the brassiere is simultaneously required to have high wearing comfort. High wearing comfort is characterized by several factors. It is desirable for the brassiere to weigh as little as possible and therefore feel very "light" to wear. Further, brassieres should be air-permeable, primarily in the hot season, so as to counteract unwanted perspiration. For brassieres to be accordingly "light" and air-permeable, they are often manufactured from thin or thin-walled materials. This has the disadvantage, however, that the nipple can show through the brassiere, which is felt by many women to be unpleasant.

In addition, women's breast tip region, i.e. the nipple (mamilla) and the pigmented area around the nipple (areola), is a particularly sensitive region of the breasts. This region must thus be particularly protected from friction and other kinds of irritation.

There is known for example from WO 2012/078387 a brassiere having a disk of polyurethane foam with a region intended for receiving the nipple provided on the inner side of the cups. However, the insertion of such a disk increases the weight of the brassiere and furthermore hinders the air circulation.

In DE 20 2013 003 542 U1 is disclosed a brassiere providing a spacer fabric as an inner layer on the inner side of the cups. Said spacer fabric is a three-dimensional textile material that is formed by two mutually opposing cover layers. The space between the cover layers enables a circulation of air, which counteracts unwanted perspiration. Further, this configuration avoids the nipple showing.

A brassiere with padding is disclosed in DE 197 23 317 A1. The brassiere has a cup which is separated from the wearer's skin by a thin, replaceable hygienic insert. Between cups and outer wall there is sprayed in a foam filling in the desired thickness as a pad. It is disadvantageous here that the cups are connected to the outer wall in an airtight manner, thereby impeding air circulation.

The invention is based on the object of providing a brassiere that avoids the above-mentioned disadvantages.

It is an object of the invention to provide a brassiere that at the same time has high wearing comfort, covers and protects the wearer's breast tip region, has improved ventilation and counteracts unwanted perspiration.

The invention is based on the finding that all the above-mentioned objects are achieved by elements arranged on the brassiere's cups' inner side facing the wearer's body, wherein the elements only partly cover the cups' inner side facing the wearer's body.

The invention is further based on the finding that all the above-mentioned objects can be achieved by a cup having an element and at least one net structure.

A first subject matter of the invention is a brassiere having cups, straps and elements for covering the wearer's breast tip region, wherein the elements are respectively arranged on the cups' inner side facing the wearer's body, and the elements only partly cover the cups' inner side facing the wearer's body.

The brassiere according to the invention has numerous advantages. Usually, the cups lie directly and completely, or nearly completely, on the skin of the wearer's breasts. This restricts ventilation, thereby leading to increased perspiration. With the brassiere according to the invention, however, only the elements arranged on the cups' inner side rest on the wearer's skin in the breast tip region. The elements hence act as a kind of spacer between the skin of the wearer's breasts and the cups, and the cups thus do not come to lie on the wearer's skin, or do so only partly. This achieves improved ventilation for the wearer's breasts and reduces or completely avoids unwanted perspiration.

The element comes to lie, at least partly, directly on the wearer's skin. Through this direct contact between element and skin the element is "fixed" on the skin to a greater degree than the cup arranged thereabove. When the breasts move, for example due to the wearer walking or changing her posture, only the element follows these movements and not, or only slightly, the cup thereabove. This decoupling of the movements between the element and the cup thereabove contributes to a significant improvement of wearing comfort.

Since the elements cover the wearer's breast tip region and avoid the nipple showing through the brassiere, the elements furthermore have a concealing function or effect. The element can hence also be designated as a concealing element.

Further, each element gives the cups higher mechanical stability. The elements are particularly advantageous with cups made of thin-walled fabric, since thinner-walled fabrics wrinkle more easily, can fold in, and cannot support and hold the wearer's breasts as well. The elements hence exert a stabilizing function for the cups and the brassiere, as well as a supporting and holding function for the wearer's breasts.

One element is respectively associated with one cup of the brassiere. Partial covering as intended by this application means that the area of the respective element is smaller than the area of the respective cup. Preferably, the element covers no more than 90% of the area of the cup, more preferably no more than 80% of the area of the cup, more preferably no more than 70% of the area of the cup, more preferably no more than 60% of the area of the cup, more preferably no more than 50% of the area of the cup, more preferably no more than 40% of the area of the cup, more preferably no more than 30% of the area of the cup, more preferably no more than 20% of the area of the cup, and most preferably no more than 10% of the area of the cup.

The size of the breast, of the nipple and in particular the size of the areola vary from woman to woman. Accordingly, the element can assume different sizes and/or shapes in order to cover at least the wearer's breast tip region, i.e. the nipple and areola. The element preferably has an area of at most 400 $cm^2$, more preferably of at most 300 $cm^2$, more preferably of at most 200 $cm^2$, more preferably of at most 100 $cm^2$, more preferably of at most 50 $cm^2$, more preferably of at most 25 $cm^2$, more preferably of at most 16 $cm^2$, more preferably of at most 12 $cm^2$, and most preferably of at most 9 $cm^2$. The element is usually larger than 1 $cm^2$ or 2 $cm^2$.

Preferably, the elements cover exactly the wearer's breast tip region. The area of the element then corresponds exactly to the area of the wearer's areola.

The perspiration area as intended by this invention designates those areas of the skin on the wearer's breasts that are not covered by the element. It is obvious that the area of the element is inverse to the perspiration area. This means that the available perspiration area is the greater the smaller the area of the element is. A large perspiration area enables improved and larger-area ventilation and reduces or avoids unwanted perspiration.

The elements are preferably of flat design. Flat means that the dimensions of the elements are greater than their thickness both in their vertical direction and in their horizontal direction. Vertical direction means that direction extending parallel or substantially parallel to the longitudinal axis of the wearer's body. Horizontal direction means that direction extending transversely or substantially transversely to the longitudinal axis of the wearer's body. The thickness of the element is preferably smaller than 5 cm, 3 cm, 2 cm, 1.5 cm or 1 cm. Usually, the thickness of the element is greater than 0.5 mm, 1 mm, 3 mm or 5 mm.

The elements can assume in principle any form. The elements preferably have a star-shaped, heart-shaped or Y-shaped form. The form of the element can be chosen in dependence on the desired size of the perspiration area and/or according to the shape and/or size of the wearer's breast.

Preferably, the elements are respectively arranged in the brassiere in a vertical alignment for supporting the breasts. Vertical alignment means an alignment parallel, or substantially parallel, to the longitudinal axis of the wearer's body. An element arranged in such a vertical alignment not only covers the breast tips but at the same time also supports the wearer's breasts. Thus, the vertical alignment of the element enhances the supporting, holding and wearing function of the brassiere.

The elements preferably comprise, or preferably consist of, foamed material, fibers, spacer material, two or more fabric layers or combinations thereof. The fabric layers can consist for example of cotton, spandex, polyamide, polyester or combinations thereof. The fibers can be for example microfibers. The foamed material can be made of polypropylene, polyethylene, polyethylene terephthalate (PET), polystyrene, biopolymers or mixtures thereof. The foamed material is preferably holed, perforated or continuous. A holed and/or perforated foamed material has the advantage of higher air permeability and thus reduced perspiration. Further, the foamed material can be laminated or non-laminated. In a preferred embodiment, the elements comprise a combination of foamed material and fibers or the elements consist of a combination of foamed material and fibers.

Preferably, the elements have an anisotropic elasticity. An anisotropic elasticity means that the elements have lower elasticity in their vertical direction than in their horizontal direction. The terms vertical direction and horizontal direction are defined as above.

Preferably, the elements are connected to the brassiere at at least two, more preferably at three or more positions. The elements can thus be fastened to, if present, the cup, one or more frames of the cup, a center gore, the strap, the apex and/or a bottom band of the brassiere. The connection can be effected by means of stitching, bonding and/or welding. Apex is understood to be that region of the brassiere where the respective cup is connected to the strap associated therewith. Preferably, the elements are respectively connected to the brassiere at least at the strap and in the lower region of the cup.

The elements are preferably interconnected or merge into each other. In one embodiment, the elements are interconnected by means of one, two, three or a plurality of links extending from one element to the other element via an inter-breast region. The links can for example be respectively fastened, for example by stitching, bonding and/or welding, to the respective element's edge facing the inter-breast region. The links can be made of the same material as the elements, or of another material. The other material can preferably be an elastic material, such as rubber or spandex. The form of the links can be for example that of a thread, a strip or a band. In another embodiment, the elements are formed such that they respectively extend into the inter-breast region and are interconnected there directly, that is, without any link. The elements can in this case be interconnected by means of stitching, bonding and/or welding.

When the two elements of the brassiere are formed such that they merge into each other in the inter-breast region, the two elements form a one-pieced unit or single element.

It will be appreciated that, in these embodiments in which the two elements form a one-pieced unit or single element, the area of said one-pieced unit or single element has at least twice the area of one element. Hence, the one-pieced unit or single element preferably has an area of at most 800 $cm^2$, more preferably of at most 600 $cm^2$, more preferably of at most 400 $cm^2$, more preferably of at most 200 $cm^2$, more preferably of at most 100 $cm^2$, more preferably of at most 50 $cm^2$. The one-pieced unit or single element is usually larger than 10 $cm^2$ or 20 $cm^2$.

Such a connection of the two elements in the brassiere provides substantial advantages. The connection causes the two elements to be coupled with each other, thereby increasing both the stability and wearing comfort of the brassiere and the support of the wearer's breasts. It is known that a particular posture, a change of posture or sporting activity can make the wearer's breasts move independently of each other and/or unequally, which primarily in the case of large breasts can entail an unpleasant feeling of skin tension, for example in the chest region. When the wearer lies down on her back, the breasts can move away from the middle of the body toward the side, leading to tension of the skin in the inter-breast region. Comparable tension can also result when the wearer changes position to lie on her side or engages in sports. However, the elements interconnected or coupled with each other according to the invention and at least largely resting directly on the breasts and fixing them prevent the breasts from moving independently of each other and/or unequally. This therefore significantly reduces or completely avoids an unpleasant feeling of tension.

The above-described advantages also apply to brassieres according to the invention in which the two elements merge into each other in the inter-breast region and therefore form a one-pieced unit or single element. Such an embodiment entails a uniform or "synchronized" movement of the breasts even during sporting activity, thereby avoiding a feeling of tension.

In a preferred embodiment, the brassiere is configured as a top, the cups are made of an opaque material, the elements merge into each other in the inter-breast region and form a one-pieced unit. Said one-pieced unit is fastened to the respective apexes as well as to the respective lower frame of the cups.

Preferably, the elements respectively have at least two, preferably three or a plurality of, connection pieces with which the elements are connected to the brassiere. The connection pieces are preferably elastic, and can comprise for example rubber and/or spandex or consist thereof. The elastic configuration of the connection pieces causes the element to be fixed primarily on the wearer's skin in the breast tip region.

The cups preferably have a net structure, or consist of a net structure. The cups can preferably also comprise an air-permeable, holed and/or perforated fabric, or consist thereof. This embodiment enables higher air permeability, which in turn reduces or totally avoids perspiration. The highest air permeability is obtained with a net structure. In addition, the fabric or material of which the net structure is made can be transparent.

Preferably, each cup has two fabric layers between which the elements are arranged. The fabric layers can consist for example of cotton, spandex, polyamide, polyester and mixtures thereof. In this embodiment, it is therefore not the element that rests directly on the wearer's skin, but rather a fabric layer of the cup. This embodiment is advantageous when the wearer has sensitive skin, for example has an allergic reaction to one of the constituents of the element. It is evident that a skin-compatible material is chosen as the fabric here according to requirements.

Preferably, the elements have been stitched or thermally deformed. The edges of the elements are preferably welded, bonded or stitched in an open-edge manner.

Preferably, the brassiere has a center gore. The center gore can be shaped for example by the inner frame of the cups of the brassiere, and serves to stabilize the brassiere.

Preferably, the brassiere has at least one underwire. More preferably, the brassiere has one, two, three or four underwires. For example, the underwire can be arranged, at least partly, on or in the lower frame of the cups of the brassiere. In one embodiment, each cup has at least one underwire. In this embodiment, the underwire is arranged, at least partly, preferably on or in the lower frame of the cups. The underwire can be made of plastic, wire or combinations thereof. The underwire serves to support and hold the wearer's breasts. In addition, the underwire produces a "push-up" effect.

An alternative embodiment of the first subject matter of the invention is a brassiere having cups, straps and elements for covering the wearer's breast tip region, wherein the elements are respectively arranged on the outer side of the cups, and the elements only partly cover the outer side of the cups.

In this alternative embodiment of the first subject matter of the invention, the cups rest on the wearer's breasts. On the outer side of each cup there is respectively arranged an element.

The advantage of this alternative embodiment is that the elements possess a concealing function and serve to cover the wearer's breast tip region in this embodiment as well. The nipple showing through the brassiere is avoided by the concealing element. Hence, the cups can be of thin-walled configuration, consisting for example of a single fabric layer, or consist of a net structure or comprise a net structure. This achieves improved ventilation and counteracts unwanted perspiration.

A further advantage of this alternative embodiment is the increased wearing comfort even when the wearer has sensitive skin. If the wearer's skin is for example intolerant to a constituent of the element, direct contact of the element can trigger an allergic reaction on the wearer's skin. Since the cups are arranged between the respective element and the wearer's breast in this alternative embodiment, however, such an allergic reaction and/or irritated skin can be avoided even when the wearer has sensitive skin. It is evident that a skin-compatible material of the cups is chosen here according to requirements.

All preferred embodiments of the first subject matter of the invention, as described above, are also preferred embodiments of the alternative embodiment of the first subject matter of the invention, if applicable. All definitions of the first subject matter of the invention, as described above, also hold for the alternative embodiment of the first subject matter of the invention, if applicable.

Thus, for example, the elements of the brassiere of the alternative embodiment of the first subject matter of the invention are connected to the brassiere at at least two, preferably three or a plurality of, positions. Also, the two elements can be interconnected or merge into each other, as described above.

Similarly to the first subject matter of the invention, the elements only partly cover the outer area of the respective cup in this alternative embodiment. This means that the area of the respective element is smaller than the outer area of the respective cup in this alternative embodiment. Preferably, the element covers no more than 90% of the outer area of the cup, more preferably no more than 80% of the outer area of the cup, more preferably no more than 70% of the outer area of the cup, more preferably no more than 60% of the outer area of the cup, more preferably no more than 50% of the outer area of the cup, more preferably no more than 40% of the outer area of the cup, more preferably no more than 30% of the outer area of the cup, more preferably no more than 20% of the outer area of the cup, and most preferably no more than 10% of the outer area of the cup.

In a preferred embodiment, the brassiere according to the invention as described above is configured as a top, in particular a sports top. In a further preferred embodiment, the brassiere according to the invention as described above is configured as a bustier.

A second subject matter of the invention is a brassiere having cups, straps and elements for covering the wearer's breast tip region, wherein each cup has an element and at least one net structure. Preferably, each cup consists of an element and at least one net structure.

All preferred embodiments of the first subject matter of the invention, as described above, are also preferred embodiments of the second subject matter of the invention, if applicable. All definitions of the first subject matter of the invention, as described above, also hold for the second subject matter of the invention, if applicable.

The second subject matter of the invention has, if applicable, the above-described advantages of the first subject matter of the invention. In particular, the second subject matter of the invention has improved ventilation for the wearer's breasts, thereby reducing or completely avoiding unwanted perspiration. Further, the brassiere according to the invention is characterized by high wearing comfort and a "light wearing feel".

The element preferably has an area of at most 400 $cm^2$, more preferably of at most 300 $cm^2$, more preferably of at most 200 $cm^2$, more preferably of at most 100 $cm^2$, more preferably of at most 50 $cm^2$, more preferably of at most 25 $cm^2$, more preferably of at most 16 $cm^2$, more preferably of at most 12 $cm^2$, and most preferably of at most 9 $cm^2$. The element is usually larger than 1 $cm^2$ or 2 $cm^2$.

Preferably, each cup has at least two, more preferably three, four or a plurality of net portions. The higher the number of net portions, the larger the perspiration area is and reduces or avoids the perspiration involved.

In addition, the position of the net portions in the cup can also be used to control the ventilation in a targeted manner. Preferably, the edge region of the cup has a net structure. The net portions can be arranged for example in the region of the lower frame, of the outer frame and/or of the inner frame of the cup.

Preferably, the region between the respective elements of the cups has a net structure. More preferably, the region between the respective elements of the cups consists of a net structure. Such an embodiment of the brassiere enables a significantly higher ventilation of the breasts, in particular in the wearer's inter-breast region.

In one embodiment, the region between the respective elements of the cups has at least one net structure and a center gore. A center gore increases the stability of the brassiere.

Preferably, each element is connected to an apex of the brassiere and at at least one position to a lower frame of the cup. However, each element can preferably also be connected to a lower frame of the cup at two, three, four or five positions.

Further details, features and advantages of the subject matter of the invention will emerge from the following description of the appurtenant figures, in which a preferred embodiment example of the invention is represented by way of example.

Figure 2:
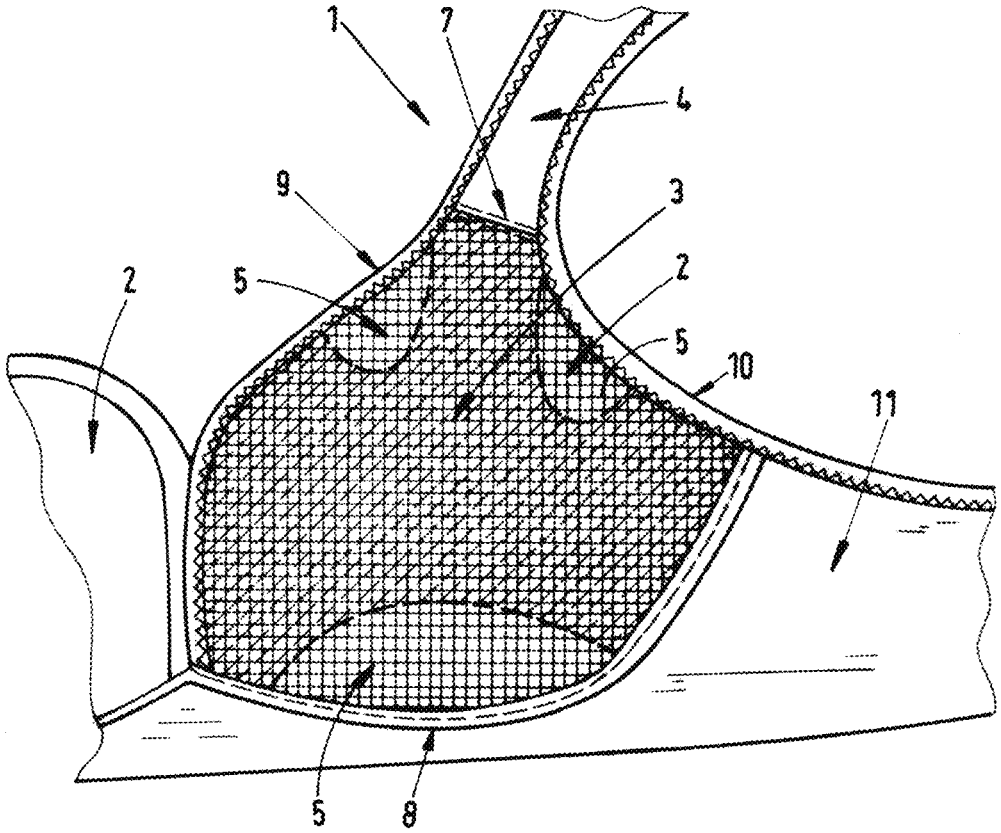
Figure 3:
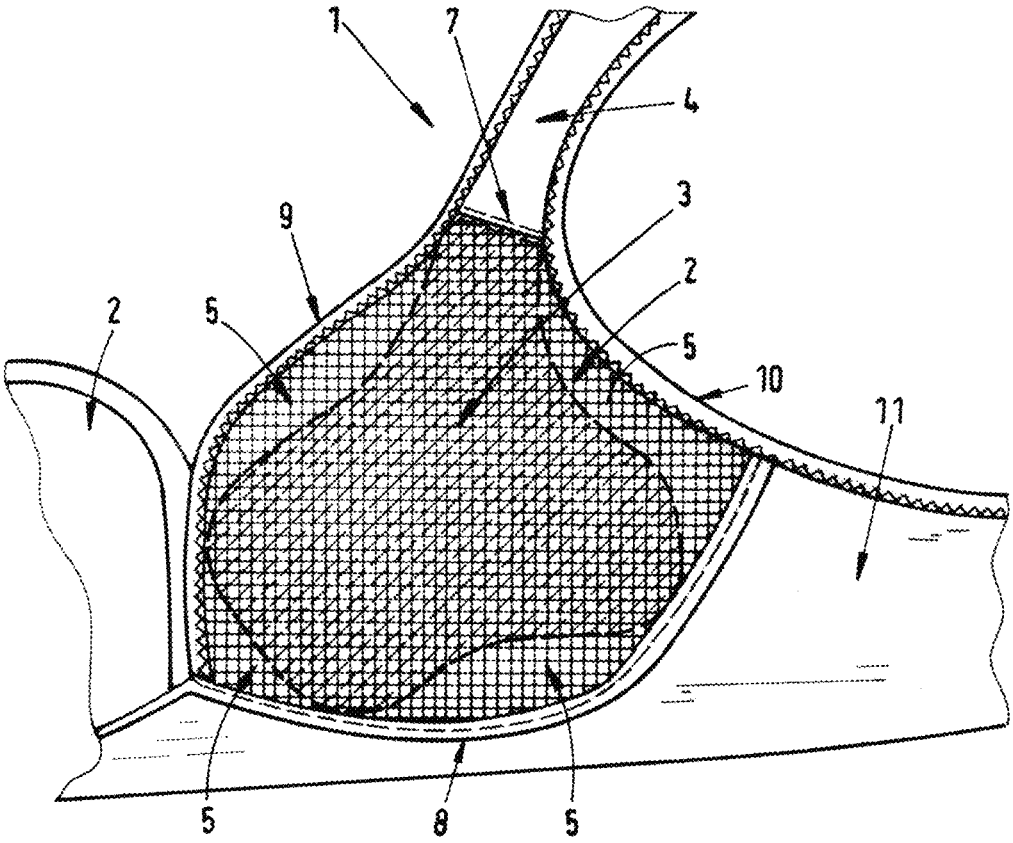
Figure 4:
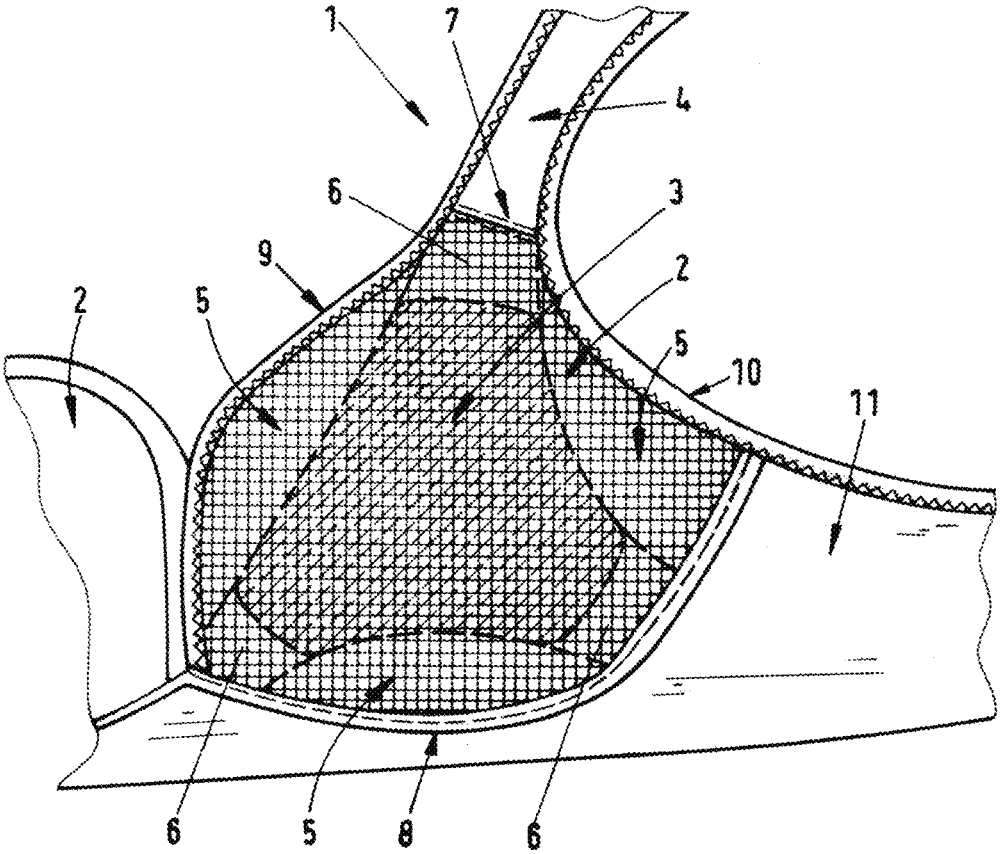
Figure 5:
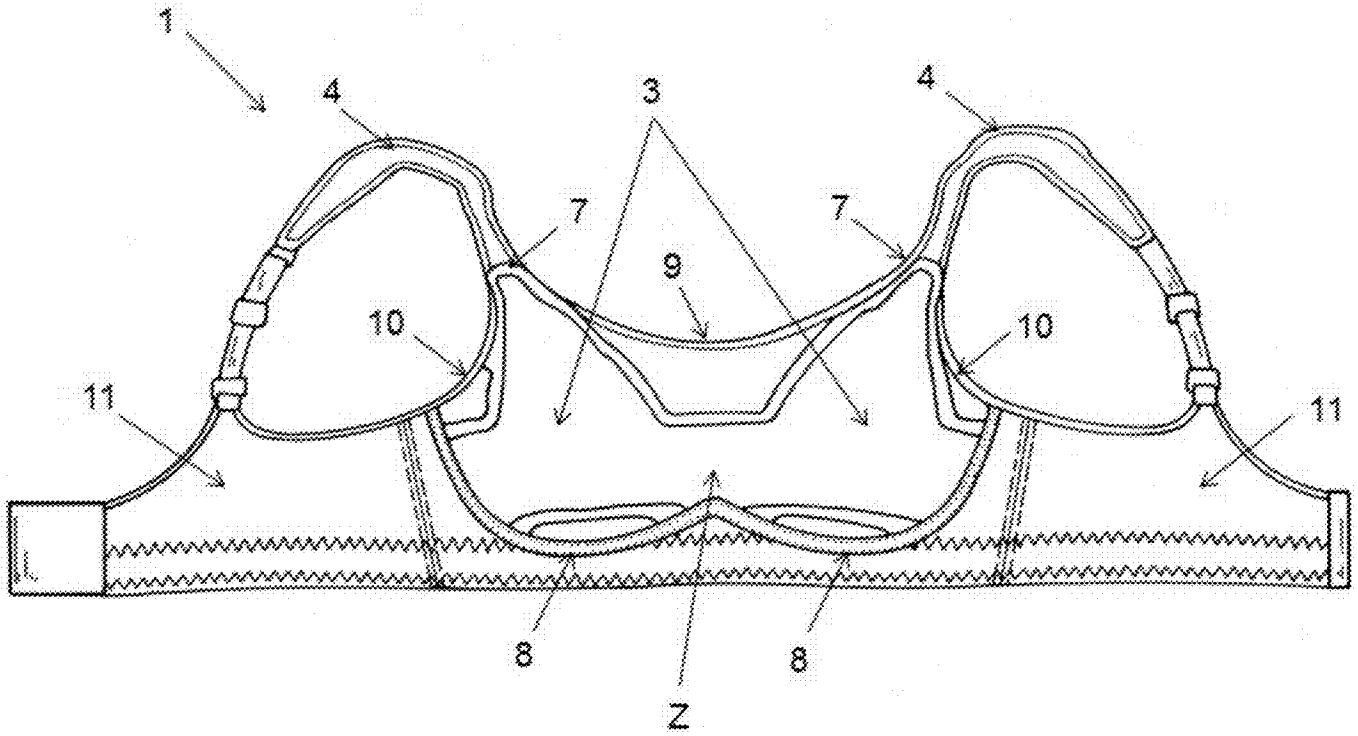
Figure 6:
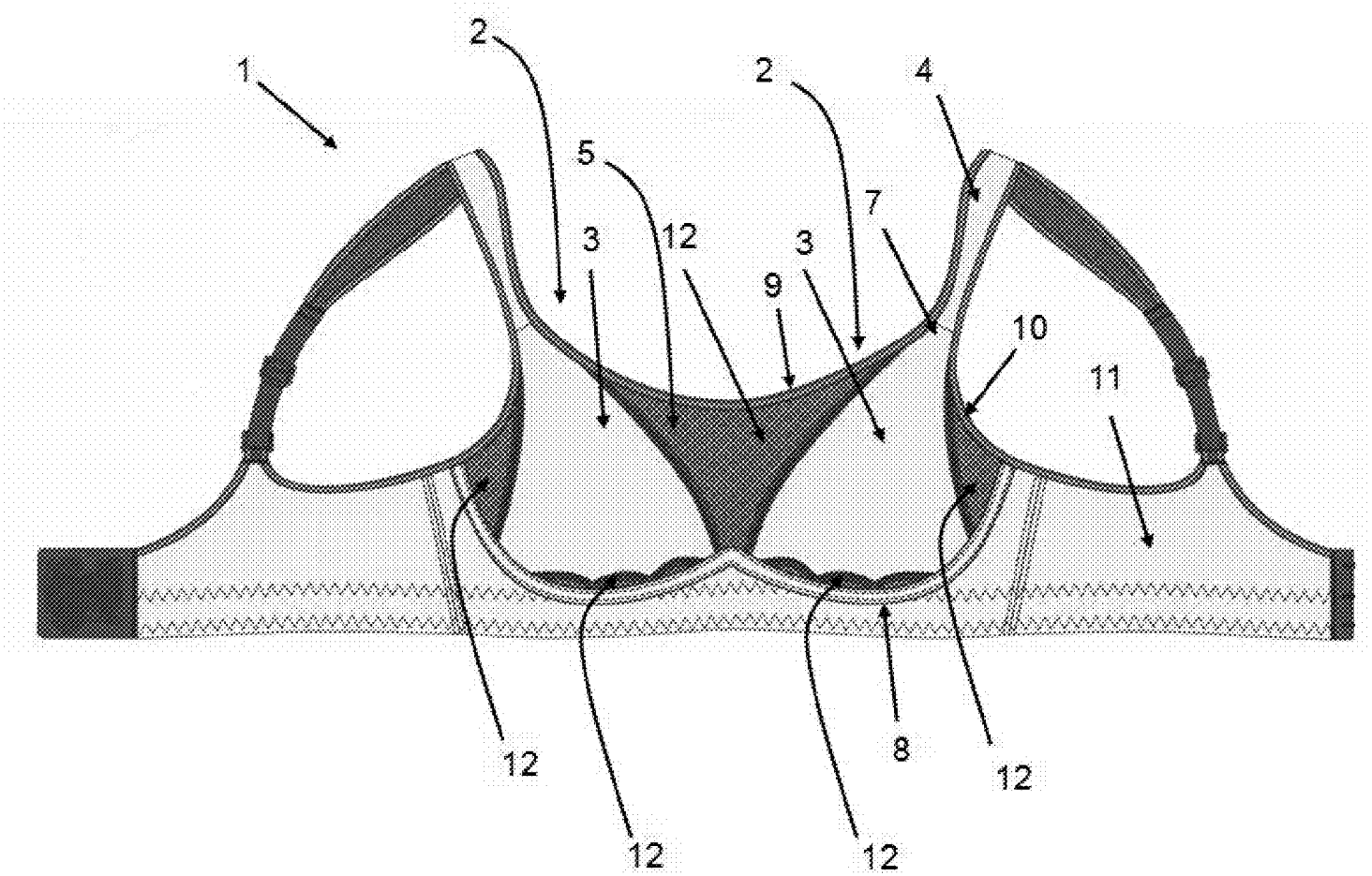
Figure 7:
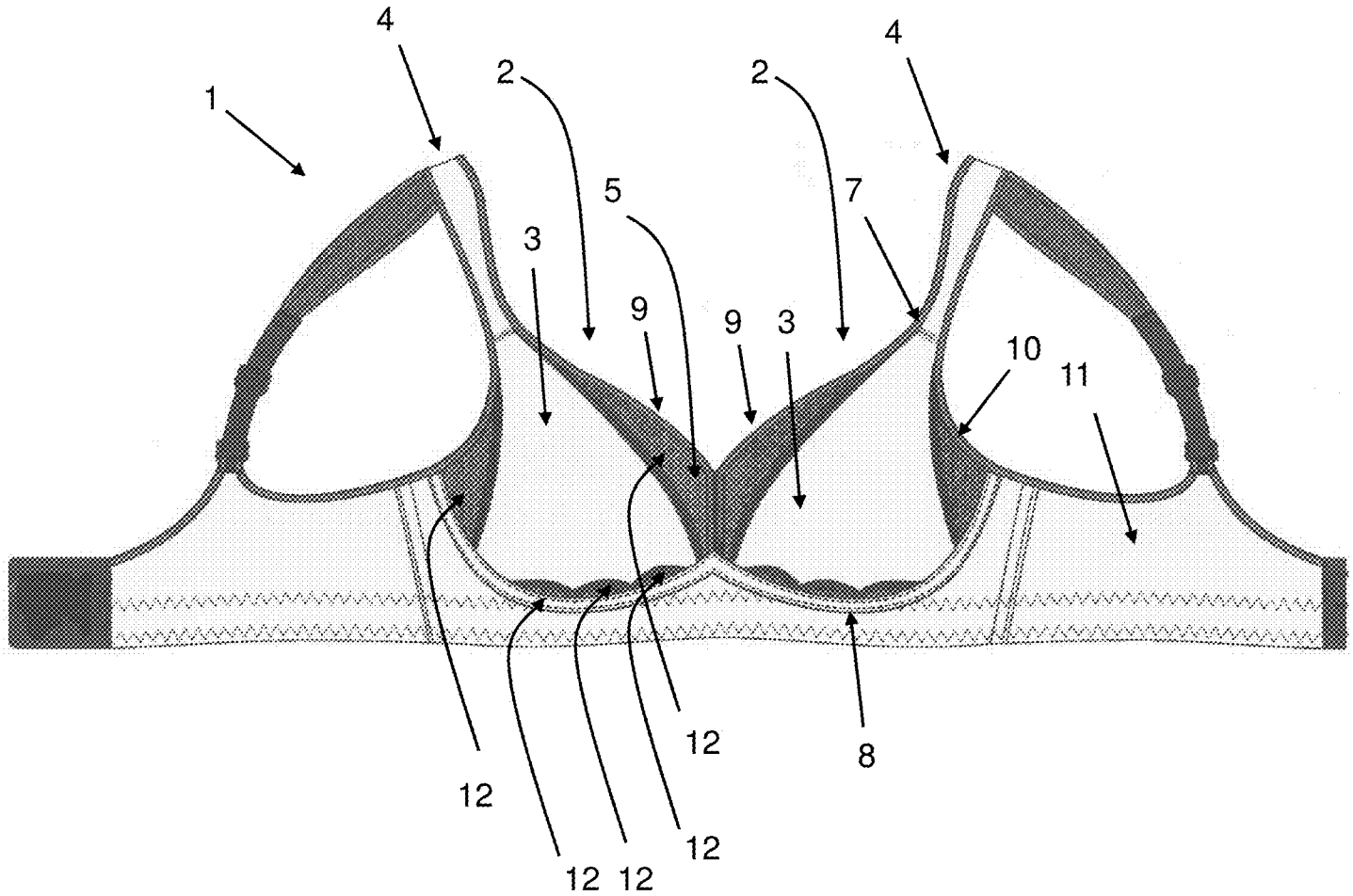

Therein are shown:

FIG. 1 a detail of a first embodiment of the brassiere according to the invention having a Y-shaped element, FIG. 2 a detail of a second embodiment of the brassiere according to the invention having a star-shaped element, FIG. 3 a detail of a third embodiment of the brassiere according to the invention having a heart-shaped element, FIG. 4 a detail of a fourth embodiment of the brassiere according to the invention having a Y-shaped element and connection pieces, FIG. 5 an inside view of a further embodiment of the brassiere according to the invention in the form of a top, in which the elements of the two cups are interconnected in the middle, FIG. 6 an outside view of a further embodiment of the brassiere according to the invention in the form of a top, in which each cup has an element and net structures, and FIG. 7 an outside view of a further embodiment of the brassiere according to the invention, in which each cup has an element and net structures, as well as a center gore.

In FIGS. 1 to 5 are to be seen exemplary embodiments of the first subject matter of the brassiere (1) according to the invention. The brassiere (1) has two cups (2), wherein an element (3) is respectively arranged on a cup's (2) inner side facing the wearer's body. Further, the brassiere (1) has straps (4) guided over the wearer's shoulders. The two side portions (11) of the brassiere (1) beginning in the region of the cups (2) run around the wearer's torso.

In FIG. 1 is shown a detail of a first embodiment of the brassiere (1) according to the invention having a Y-shaped element (3). The brassiere has two mutually adjacent cups (2), with each cup (2) being limited by an inner (9), outer (10) and lower (8) frame as well as the apex (7). The lower regions of the two inner frames (9) of the respective cups (2) are interconnected and form a center gore. At the apex (7) of the cup (2) there is further fastened the strap (4) guided over the wearer's shoulders. The Y-shaped element (3) is connected to the brassiere (1) at three positions, once at the apex (7) and twice at the lower frame (8) of the cup (2). The element (3) is a holed foam in this embodiment example and covers about 55% of the area of the cup (2) in this embodiment. This results in three ventilation areas or perspiration areas (5) as shown in FIG. 1. In alternative embodiments, an underwire made of plastic is incorporated into the lower frame (8) for supporting and holding the wearer's breasts.

FIG. 2 shows a further embodiment example of the brassiere (1) according to the invention. The brassiere (1) is similar to that of FIG. 1 but has a star-shaped element (3). The element (3) is connected to the brassiere (1) at three positions, namely, at the apex (7) and in the inner frame (9)/lower frame (8) region and in the lower frame (8)/outer frame (10) region. The element (3) covers about 75% of the area of the cup (2) in this embodiment. Here, too, there result three ventilation areas or perspiration areas (5) as shown in FIG. 2.

A further embodiment example of the brassiere (1) according to the invention having a heart-shaped element (3) is shown in FIG. 3. The heart-shaped element (3) is connected to the brassiere (1) at four positions. Firstly, at the apex (7), and respectively at the inner (9) and lower (8) frames of the cup (2). The element (3) covers about 75% of the area of the cup (2) in this embodiment. There result four ventilation areas or perspiration areas (5) as shown in FIG. 3.

In FIG. 4 is shown a detail of a further embodiment of the brassiere (1) according to the invention having a Y-shaped element (3). Unlike the embodiment of FIG. 1, the element (3) in this embodiment has at each end a connection piece (6) with which the element (3) is connected to the brassiere (1). The Y-shaped element (3) is connected to the brassiere (1) via the respective connection piece (6) at three positions, namely, at the apex (7), at the lower frame (8) of the cup (2) and in the transition region between inner frame (9) and lower frame (8) of the cup (2). The element (3) covers about 55% of the area of the cup (2) in this embodiment. This results in three ventilation areas or perspiration areas (5) as shown in FIG. 4.

FIG. 5 shows an inside view of a further embodiment of the brassiere (1) according to the invention in the form of a top. The brassiere (1) has two cups (2), two straps (4) and two side portions (11). The respective straps (4) are connected to the respective cup (2) at the apex (7). The cups (2) are made of an opaque material, such as cotton, and are limited by their respective outer (10) and respective lower (8) frame as well as by a common inner frame (9). The brassiere (1) further has two elements (3) arranged on the inner side of the respective cups (2). Each element (3) has a trianguloid basic shape and is connected to the brassiere (1) at the respective apex (7) and at the respective lower frame (8) of the cups (2). In this embodiment example, the elements (3) are in addition formed such that they respectively extend as far as an inter-breast region (Z) and merge into each other there. The two elements (3) therefore form a one-pieced unit or single element (3). The advantages of such a configuration of the elements (3) are that said one-pieced unit not only has a stabilizing effect on the brassiere (1) but also additionally supports the wearer's breasts and reduces or even prevents skin tension, primarily in the inter-breast region.

FIGS. 6 and 7 show exemplary embodiments of the second subject matter of the brassiere (1) according to the invention.

FIG. 6 shows a first embodiment example of the second subject matter of the present invention. The brassiere (1) has two cups (2), wherein each cup (2) has an element (3) and a plurality of net structures (12). The two cups (2) are limited by an inner (9), outer (10) and lower (8) frame as well as the apex (7). The brassiere (1) is configured in this embodiment example as a top, i.e. it has no division or center gore in the inter-breast region between the two cups (2). Hence, the two cups (2) have a common inner frame (9) which extends continuously from the apex (7) of the left cup (2) to the apex (7) of the right cup (2). The region between the inner frame (9) and the respective elements (3) of the cups (2) has a net structure (12). The nine net structures (12) shown are at the same time perspiration areas (5). Said net structures (12) are stitched to the elements (3), the inner frame (9) and/or a part of the lower frame (8). Further, the brassiere (1) comprises straps (4) guided over the wearer's shoulders. The two side portions (11) of the brassiere (1) beginning in the region of the cups (2) run around the wearer's torso.

FIG. 7 shows a further embodiment of the second subject matter of the brassiere (1) according to the invention. Unlike FIG. 5, each cup (2) has an inner frame (9). These lower regions of the two inner frames (9) of the respective cups (2) are interconnected and form a center gore.

LIST OF REFERENCE SIGNS

1 Brassiere
2 Cup
3 Element
4 Strap
5 Perspiration area
6 Connection piece
7 Apex
8 Lower frame of cup (2)
9 Inner frame of cup (2)
10 Outer frame of cup (2)
11 Side portion
12 Net structure
Z Inter-breast region

The invention claimed is:

1. A brassiere comprising:
cups, each cup having at least one frame,
straps, each strap connecting to a cup at an apex,
a bottom band, and
elements configured to cover a wearer's breast tip region, wherein the elements are respectively arranged on a cup's inner side that faces a wearer's body, and the elements only partly cover the cups' inner side facing the wearer's body, and the elements are connected to the brassiere in at least three positions, at least one of the positions being the apex, and the remaining positions including one or more frames of the cup, the strap, or the bottom band.

2. The brassiere according to claim 1, wherein the elements are interconnected or merge into each other.

3. The brassiere according to claim 1, wherein the elements respectively have at least three connection pieces with which the elements are connected to the brassiere.

4. The brassiere according to claim 1, wherein the cups have a net structure.

5. The brassiere according to claim 1, wherein each cup has two fabric layers between which the elements are arranged.

6. The brassiere according to claim 1, wherein the elements have a star-shaped, heart-shaped or Y-shaped form.

7. The brassiere according to claim 1, wherein the brassiere is configured as a top, or configured as a sports brassiere.

8. The brassiere according to claim 1, wherein the brassiere has at least one underwire.

9. The brassiere according to claim 1, that further comprises a center gore, and each remaining element is connected to the brassiere in at least two positions, each position being on one or more frames of the cup, the strap, the bottom band, or the center gore.

10. The brassiere according to claim 1, in which all of the positions of connection of the elements are at one or more frames of the cup, the strap, the bottom band, the apex or the center gore.

11. A brassiere comprising:
cups having at least one frame,
straps, each strap connecting to a cup at an apex,
a bottom band, and
elements configured to cover a wearer's breast tip region, wherein each cup has an element and at least one net structure, wherein the elements are connected to the brassiere in at least three positions, at least one of the positions being the apex, and the remaining positions including one or more frames of the cup, the strap, or the bottom band.

12. The brassiere according to claim 11, wherein each cup has at least two net portions.

13. The brassiere according to claim 11, wherein an edge region of the cup has a net structure.

14. The brassiere according to claim 11, having a net structure between the respective elements of the cups.

15. The brassiere according to claim 11, wherein at least one remaining element is connected to at least one position of a lower frame of the cup.

16. The brassiere according to claim 11, wherein the elements have a star-shaped, heart-shaped or Y-shaped form.

17. The brassiere according to claim 11, wherein the brassiere is configured as a top or configured as a sports brassiere.

18. The brassiere according to claim 11, wherein the brassiere has at least one underwire.

19. The brassiere according to claim 11, in which all of the positions of connection of the elements are at one or more frames of the cup, the strap, the bottom band, the apex or the center gore.

20. A brassiere having cups having an outer side and at least one frame, straps connecting to the cups at an apex, a bottom band and elements configured to cover a wearer's breast tip region, wherein the elements are respectively arranged on the outer side of the cups, and the elements only partly cover the outer side of the cups, wherein the elements are connected to the brassiere in at least three positions, at least one of the positions being the apex, and the remaining positions including one or more frames of the cup, the strap, or the bottom band.

21. The brassiere according to claim 20, wherein the elements are interconnected or merge into each other.

22. The brassiere according to claim 20, wherein the elements respectively have at least three connection pieces with which the elements are connected to the brassiere.

23. The brassiere according to claim 20, wherein the cups have a net structure.

24. The brassiere according to claim 20, wherein each cup has two fabric layers between which the elements are arranged.

25. The brassiere according to claim 20, wherein the elements have a star-shaped, heart-shaped or Y-shaped form.

26. The brassiere according to claim 20, wherein the brassiere is configured as a sports brassiere.

27. The brassiere according to claim 20, wherein the brassiere has at least one underwire.

28. The brassiere according to claim 11, that further comprises a center gore, and each remaining element is connected to the brassiere in at least two positions, each position being on one or more frames of the cup, the strap, the bottom band, or the center gore.

29. The brassiere according to claim 19, that further comprises a center gore, and each remaining element is connected to the brassiere in at least two positions, each position being on one or more frames of the cup, the strap, the bottom band, or the center gore.

30. The brassiere according to claim 1, in which all of the positions of connection of the elements are at one or more frames of the cup, the strap, the bottom band, the apex or the center gore.

* * * * *